United States Patent [19]

Braun et al.

[11] 4,283,023

[45] Aug. 11, 1981

[54] WINDER APPARATUS FOR A PAPER MACHINE

[75] Inventors: Heinz Braun, Ravensburg; Karl Kiesel, Mochenwangen; Wolf-Gunter Stotz, Ravensburg, all of Fed. Rep. of Germany

[73] Assignee: Escher Wyss GmbH, Ravensburg, Fed. Rep. of Germany

[21] Appl. No.: 198,806

[22] Filed: Oct. 20, 1980

Related U.S. Application Data

[63] Continuation of Ser. No. 970,623, Dec. 18, 1978, abandoned.

[30] Foreign Application Priority Data

Mar. 22, 1978 [CH] Switzerland ..... 3126/78

[51] Int. Cl.[3] ..... B65H 17/14

[52] U.S. Cl. ..... 242/67.1 R; 242/75.1

[58] Field of Search ..... 242/75.1, 67.1 R, 67.2, 242/67.3 R, 67.4, 67.5, 56 R, DIG. 3, 68.7, 65, 66; 100/87, 88

[56] References Cited

U.S. PATENT DOCUMENTS

| | | | |
|---|---|---|---|
| 2,353,821 | 7/1944 | Fourness et al. | 242/67.1 R |
| 2,355,318 | 8/1944 | Moravek | 242/75.1 X |
| 3,061,225 | 10/1962 | Huck | 242/75.1 |
| 3,392,930 | 7/1968 | Goldfarb | 242/67.2 |
| 4,034,928 | 7/1977 | McDonald et al. | 242/67.1 R |
| 4,063,693 | 12/1977 | Achelpohl | 242/67.1 R |

*Primary Examiner*—John M. Jillions

*Attorney, Agent, or Firm*—Werner W. Kleeman

[57] ABSTRACT

A winder apparatus for a papermaking machine for winding-up a paper web onto a reel-spool, comprising an endless sieve or filter band arrangement which is guided over guide rolls, one of which serves as a drive roll. The band arrangement drives the reel-spool and the paper web which is wound thereon. As the drive roll there can be used the outermost guide roll viewed in the direction of driving of the reel-spool.

9 Claims, 1 Drawing Figure

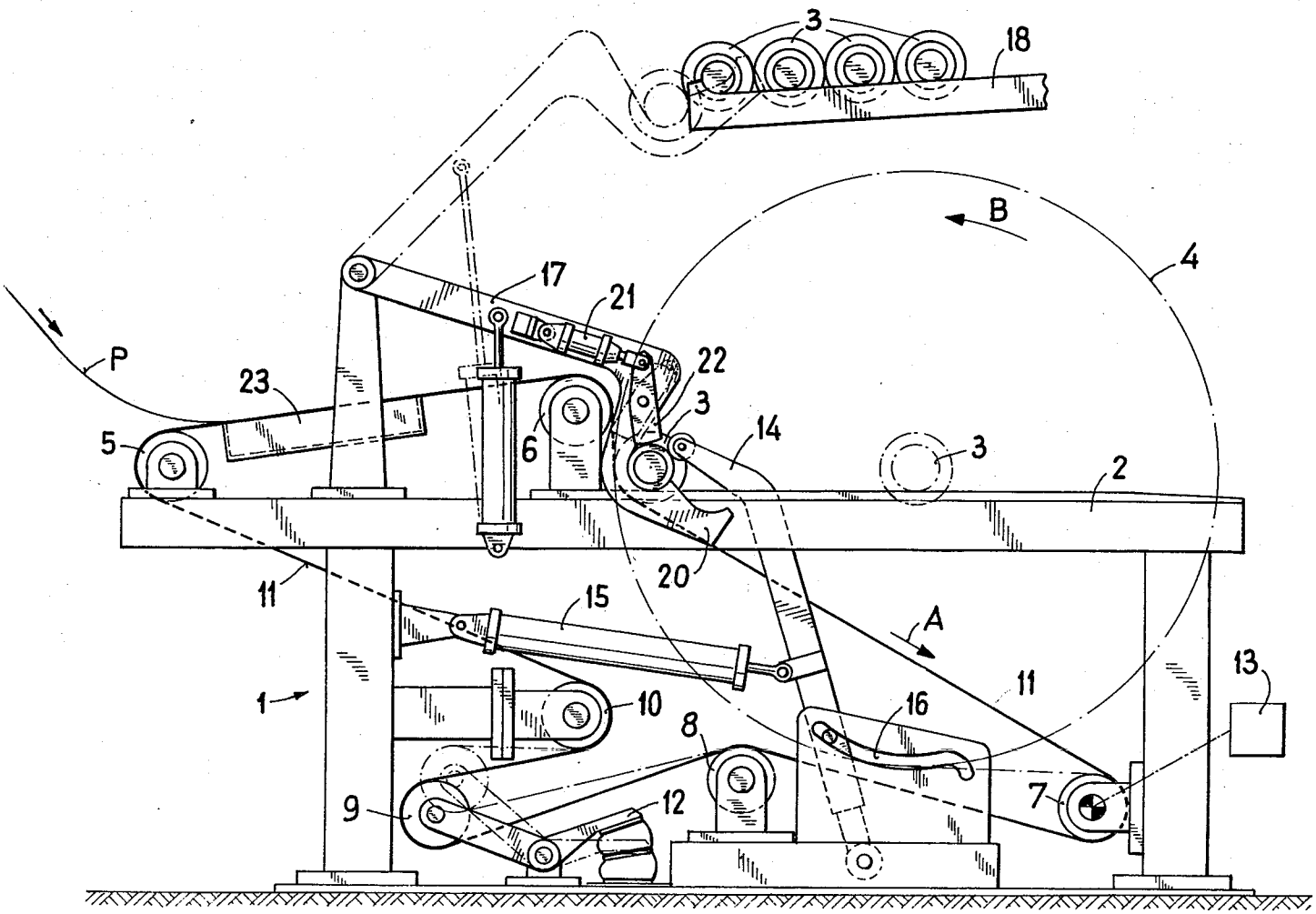
18
3
4
B
2
3
13
7
11
A
16
14
22
3
20
21
17
6
15
10
8
12
9
23
11
1
5
P

WINDER APPARATUS FOR A PAPER MACHINE

CROSS-REFERENCE TO RELATED APPLICATIONS

This application is a continuation of our commonly assigned U.S. application Ser. No. 970,623, filed Dec. 18, 1978, now abandoned, and also is a related application to our commonly assigned, copending U.S. application Ser. No. 899,283, filed Apr. 24, 1978, entitled "Winder For a Papermaking Machine", now U.S. Pat. No. 4,143,828, granted Mar. 13, 1979.

BACKGROUND OF THE INVENTION

The present invention relates to a new and improved construction of winder or winder apparatus for a papermaking machine, sometimes referred to simply as a paper machine.

In our aforementioned copending U.S. application, now U.S. Pat. No. 4,143,248, there is disclosed a winder apparatus for a papermaking machine comprising a cylinder having an outer surface over which there is guided a paper web moving in a predetermined direction of travel and which is to be wound-up into a paper roll. A reel-spool receives the paper web from the cylinder and winds-up such paper web thereon into a paper roll. A contact device presses the reel-spool in the direction of the cylinder.

With this proposed winder apparatus a sieve or filter band is guided over the otherwise standard cylinder, this filter band training about the reel-spool and the paper roll wound thereon. In this way there is achieved an improved winding action, especially with regard to difficult to wind paper webs, such as for instance soft tissue webs.

Specifically, with the construction of such application guide means serve for guiding the filter band in the form of an endless band arrangement so as to extend over the cylinder between its outer surface and the incoming paper web. The guide means guide the band arrangement such that this band arrangement together with the paper web wraps about part of the circumference of the cylinder, is guided between the cylinder and the reel-spool or the paper roll wound on such reel-spool and is trained about part of the circumference of the paper roll or the reel-spool when empty.

SUMMARY OF THE INVENTION

It is a primary object of the present invention to improve upon the winder apparatus of the aforementioned application, with the view of providing a novel construction of winding apparatus which, on the one hand, is simpler and less expensive than the proposed apparatus, and, on the other hand, is improved upon as concerns its mode of operation.

The winder apparatus of the present development is manifested by the features that the band arrangement is exclusively guided over guide rolls, and one of the guide rolls serves as a drive roll.

With the inventive apparatus there is completely dispensed with the need for the previously required cylinder, i.e., a roll with large diameter and having a drive, constituting an appreciable simplification of the equipment.

According to a further construction of the invention it is contemplated to use as the drive roll the outermost guide roll, viewed in the drive direction of the reel-spool. With this variant construction there is obtained an improved drive of the band arrangement which is more favorable for the winding operation, since the drive roll is first located behind the reel-spool and the paper roll wound thereon, and thus, the band arrangement is drawn directly along the paper roll.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE schematically illustrates in side view a winder apparatus constructed according to the present invention.

DETAILED DESCRIPTION OF THE PREFERRED EMBODIMENTS

Describing now the drawing, in the single FIGURE there is illustrated a winder or winder apparatus for a papermaking machine and constructed according to the invention, which will be seen to contain a support or carrier construction 1 embodying an essentially horizontal guide means 2 for the reel-spool or spool means 3 upon which there is wound-up a paper roll 4. Mounted upon the support construction 1 are the guide rolls or rollers 5, 6, 7, 8, 9 and 10 over which there is guided an endless filter or sieve band arrangement 11. The guide roll 9 is constructed in conventional manner as a tensioning roll and equipped with a fluid-operated, here a pneumatic tensioning mechanism or device 12. The roll 7 serves as the drive roll or roller and is connected with a schematically illustrated drive motor 13. Additionally, there are provided in conventional manner press or contact arms 14 which serve to press the reel-spool 3 and the paper roll 4 wound thereon against the filter band or belt arrangement 11. These arms 14 are provided with servomotors 15 and with a cam track 16 or equivalent structure ensuring for proper movement of the ends of the arms 14 along the guide means 2.

Furthermore, there are provided pivotal infeed or delivery arms 17 which serve to remove empty reel-spools 3 from a reel-spool supply guide arrangement 18 and for the deposition thereof upon the guide means 2. The infeed arms 17 are provided in conventional manner with profiled or shaped ends 20 and are equipped with a locking mechanism 22 or equivalent structure which can be actuated by a servomotor 21.

At the section of the sieve or filter band arrangement 11 located between the guide rolls 5 and 6, serving for the reception or take-up of the infed paper web P, there is arranged a suction box 23 below the filter band arrangement 11, the suction box 23 serving as a pneumatic adhesion or holder device. It should be understood however that there also could be provided, for instance, a pneumatic blower device which, at this location, presses the paper web against the sieve or filter band arrangement 11.

During operation, the driven guide roll 7 draws the sieve or filter band arrangement 11 between it and the roll 6 in the direction of the arrow A. Consequently, the reel-spool 3 and the paper roll 4 wound thereon are rotated in the direction of the arrow B in counter-clockwise direction. Since the roll 7, viewed in the direction of movement A, i.e., in the drive direction of the reel-spool 3 with the paper roll 4, constitutes the outermost guide roll, the sieve or filter band arrangement 11 is directly drawn thereby at the region located between the rolls or rollers 6 and 7, where there is located the paper roll 4, so that the filter band arrangement experiences at this location the entire tensioning force and not a reduced tensioning force which is lowered by possibly intermediately dispositioned guide rolls.

The invention also enables a decisive simplification of the infeed device for empty reel-spools 3 in contrast to the heretofore known equipment. As apparent from the showing of the drawing, there is satisfactory for this purpose, a single arm 17 which, during each reel-spool change, places the new reel-spool so that it can roll upon the filter band arrangement 11 between the guide rolls 6 and 7. With the heretofore known apparatuses there was needed for this purpose at least two arms, namely one arm which placed the new infed reel-spool so that it would roll upon the cylinder and a second arm which thereafter brought the reel-spool with the package formed thereon so as to come into contact with the guide means 2.

As a differentiating feature of the guide rolls and cylinder, it can be stated that a cylinder, with the present day conventional width of papermaking machines, has at least a diameter of 600 millimeters. The guide rolls, on the other hand, have much smaller diameters. Additionally, as apparent from the showing of the drawing, all of the guide rolls can be advantageously provided so as to have the same diameter.

While there are shown and described present preferred embodiments of the invention, it is to be distinctly understood that the invention is not limited thereto, but may be otherwise variously embodied and practiced within the scope of the following claims. Accordingly,

What we claim is:

1. A winder apparatus for a papermaking machine comprising:

a reel-spool for winding up an infed paper web thereon so as to form a paper roll;

an endless band arrangement for guiding the paper web onto the reel-spool by taking-up said web prior to the web contacting said reel-spool and for winding said paper web thereon in the form of said paper roll;

guide means for guiding said endless band arrangement such that said band arrangement wraps about part of the reel-spool and the paper roll wound thereon over a part of the circumference thereof and thus places such reel-spool or the paper web wound on such reel-spool into rotation;

means for supporting said reel-spool against the band for rotation thereby, the support means being constructed for movement of the reel-spool in a direction transverse to its longitudinal axis away from the band as the diameter of the paper reel on the reel-spool increases;

said guide means constituting only guide rolls for exclusively guiding the band arrangement;

said guide means guiding the band arrangement such that it contacts the reel-spool and the paper roll wound thereon essentially only laterally and from below; and one of said guide rolls serving as a drive roll.

2. The winder apparatus as defined in claim 1, wherein:

the one guide roll serving as the drive roll drives the reel-spool in a predetermined drive direction and constitutes an outermost guide roll viewed with respect to said taking up of said paper web.

3. The winder apparatus as defined in claim 1, wherein:

said band arrangement comprises a filter band.

4. The winder apparatus as defined in claim 1, further including:

a pneumatic adhesion device provided for the band arrangement at a section thereof which is located in front of the reel-spool and the paper roll wound thereon, viewed with respect to the direction of movement of the band arrangement.

5. The winder apparatus as defined in claim 1, further including:

only a single element for infeeding an empty reel-spool for coaction with said endless band arrangement.

6. The winder apparatus as defined in claim 1, wherein:

each of said guide rolls of said guide means are out of contact with the reel-spool and the paper roll wound thereon.

7. The winder apparatus as defined in claim 1, wherein said guide rolls including said one guide roll serving as a drive roll exert a tension force upon the band arrangement which pre-dominantly exists between said reel-spool and the paper roll wound thereon and said drive roll.

8. The winder apparatus as defined in claim 7, wherein:

said band arrangement drives said reel-spool and the paper roll wound thereon in a predetermined direction of rotation; and said tension force extends between said reel-spool and the paper roll wound thereon and said drive roll essentially in the direction of said predetermined direction of rotation of said reel-spool and paper roll wound thereon.

9. The winder apparatus as defined in claim 1, wherein:

all of said guide rolls each have substantially the same diameter.

* * * * *